US005538650A

United States Patent [19]

Goto et al.

[11] Patent Number: 5,538,650

[45] Date of Patent: Jul. 23, 1996

[54] PROCESS FOR PRODUCING MIXTURE OF SULFURIZED ALKALINE EARTH METAL SALTS OF SALICYLIC ACID COMPOUND AND PHENOL

[75] Inventors: Masato Goto; Makoto Nishishita; Yoshihiro Kojima; Sanae Ueda, all of Saitama, Japan

[73] Assignees: Cosmo Research Institute; Cosmo Oil Co., Ltd., both of Tokyo, Japan

[21] Appl. No.: 424,566

[22] Filed: Apr. 17, 1995

Related U.S. Application Data

[63] Continuation of Ser. No. 123,066, Sep. 17, 1993, abandoned.

[30] Foreign Application Priority Data

| | | | |
|---|---|---|---|
| Sep. 18, 1992 | [JP] | Japan | 4-275026 |
| Jan. 13, 1993 | [JP] | Japan | 5-020581 |
| Mar. 30, 1993 | [JP] | Japan | 5-095394 |

[51] Int. Cl.[6] ..... C10M 159/22

[52] U.S. Cl. ..... 508/331; 508/332

[58] Field of Search ..... 252/39

[56] References Cited

U.S. PATENT DOCUMENTS

| | | | |
|---|---|---|---|
| 4,302,342 | 11/1981 | Demoures et al. | 252/39 |
| 4,719,023 | 1/1988 | MacPhairl et al. | 252/39 |
| 4,869,837 | 9/1989 | Van Wijngaarden et al. | 252/39 |
| 4,902,436 | 2/1990 | Hori et al. | 252/39 |
| 4,971,710 | 11/1990 | Liston | 252/39 |
| 5,035,816 | 7/1991 | Leone | 252/39 |
| 5,244,588 | 9/1993 | Koshima et al. | 252/39 |

FOREIGN PATENT DOCUMENTS

| | | |
|---|---|---|
| 2194695 | 3/1974 | France . |
| 2587353 | 3/1987 | France . |
| 0219382 | 4/1987 | France . |
| 2625220 | 6/1989 | France . |
| 1039792 | 8/1966 | United Kingdom . |

OTHER PUBLICATIONS

Derwent Abstract C87–045856 (abstract of cited French Reference).

*Primary Examiner*—Jacqueline V. Howard

*Attorney, Agent, or Firm*—Sughrue, Mion, Zinn, Macpeak & Seas

[57] ABSTRACT

Disclosed is a process for producing a mixture of sulfurized alkaline earth metal salts of a salicylic acid compound and a phenol which comprises reacting either a mixture of reactants comprising a phenol, a dihydric alcohol, and an alkaline earth metal oxide and/or hydroxide or a mixture of these reactants and water, subsequently distilling off water and the dihydric alcohol, reacting the resulting bottom with carbon dioxide, and then adding a dihydric alcohol and elemental sulfur to the resulting reaction product to conduct sulfurization reaction.

8 Claims, No Drawings

PROCESS FOR PRODUCING MIXTURE OF SULFURIZED ALKALINE EARTH METAL SALTS OF SALICYLIC ACID COMPOUND AND PHENOL

This is a Continuation of application Ser. No. 08/123,066 filed Sep. 17, 1993 (abandoned).

FIELD OF THE INVENTION

The present invention relates to a process for producing a salicylate and a phenate which are extremely useful as detergents to be added to lubricating oils and fuel oils. More particularly, this invention relates to a novel process for producing a salicylate/phenate mixture which process attains an improvement in the color of the mixture.

BACKGROUND OF THE INVENTION

The incorporation of sulfur into a hydroxybenzoate of an alkaline earth metal was first attempted by Orland M. Reiff, as disclosed in U.S. Pat. No. 2,256,443 (1941), in which an alkali metal alkylsalicylate obtained by the Kolbe-Schmitt process was reacted with sulfur chloride in the presence of butyl alcohol solvent to incorporate sulfur into the salicylate, and then the resulting salicylate was converted into an alkaline earth metal salt using an alkaline earth metal alcoholate. This method was distinguished for the suppression of hydrogen chloride generation.

For incorporating sulfur, Jerome M. Cohen, as disclosed in U.S. Pat. No. 3,595,791 (1971), used a method comprising metathetically reacting an alkali metal alkylsalicylate obtained by the Kolbe-Schmitt process with an alkaline earth metal halide to convert the alkali metal salt into an alkaline earth metal salt and reacting it with elemental sulfur in the presence of a Carbitol represented by the formula $R(OR_1)_xOH$ and of an alkaline earth metal oxide or hydroxide or a mixture of both (hereinafter referred to as "alkaline earth metal reagent"). This method is distinguished for the use of elemental sulfur, which is easily handled, in place of an extremely highly reactive sulfurizing reagent such as sulfur chloride.

However, the methods proposed by Reiff and Cohen each has had the following drawbacks to the industrial use thereof. The first point is that each process is complicated with a large number of steps. The Reiff process necessitates reconversion of the product of the sulfurization reaction into a free acid, while the Cohen process necessitates metathesis with an alkaline earth metal halide after the Kolbe-Schmitt reaction. Thus, such steps make the processes more complicated. The second point is that each process involves a step in which an alkali metal halide is generated as a by-product; inclusion of such a strong electrolyte into the product is undesirable from a quality standpoint.

On the other hand, a reaction in which an alkaline earth metal complex of an alkylphenol and carbon dioxide are used in combination has been utilized in the field of the phenate industry which is competing with the salicylate industry (see Nishikawa and Ishibe, PETROTECH, 7, 338 (1984)).

It has been generally thought that the reaction involving such a combination does not yield a salicylic acid compound, as already reported by John S. Bradley et al., as disclosed in U.S. Pat. No. 2,916,454 (1959). Accordingly, the present inventors succeeded in obtaining a mixture of sulfurized hydroxyalkylbenzoate of an alkaline earth metal and an alkylphenol and obtaining a process for producing the mixture, by mixing and reacting an alkaline earth metal oxide with an alkylphenol and a dihydric alcohol, subsequently distilling off water and the dihydric alcohol, treating the thus-obtained alkaline earth metal phenate with carbon dioxide in the presence of an alkylphenol to form a hydroxyalkylbenzoate, and then reacting it with elemental sulfur, as disclosed in U.S. Pat. No. 4,902,436 (1990). This method, which explodes the established theory that the presence of a phenol prevents the formation of an alkylsalicylic acid (e.g., James Hartley, British Patent 734,622 (1955), page 1, line 34 et seq.), is distinguished for the significantly simplified process which is attained by yielding an alkaline earth metal hydroxyalkylbenzoate directly from an alkaline earth metal phenate without the necessity of using an alkali metal.

The above method, however, has had drawbacks that the total base number of the product obtained is relatively low from an operation efficiency standpoint and decarboxylation reaction is apt to take place in the sulfurization step, and that the product obtained has a considerably dark color.

Furthermore, in the process according to the present invention, when the sulfurization reaction is conducted at atmospheric pressure or in a pressurized closed system, it has been disadvantageous in that the recovered phenols after the reaction become milky. It is preferred to be capable of reusing the recovered phenols. If they cannot be reused, a further considerable cost becomes necessary since the process requires a great amount of phenols. Though the reason why the recovered phenols become milky is uncertain, it is supposed that in producing a mixture of sulfurized alkaline earth metal salts of a salicylic acid and a phenol, the sulfurization is conducted in the presence of a dihydric alcohol in the latter reaction stage, whereby by-products such as polysulfides contaminate the recovered phenols. The resulting milky phenols are low in a commercial value as phenols. Moreover, it is expected that the reuse of the milky phenols would cause undesirable side reactions in the production of a phenate and a salicylate, and the milky phenols cause a reduction in the oil solubility of a final product.

SUMMARY OF THE INVENTION

An object of the present invention is to provide a process for producing a mixture of sulfurized alkaline earth metal salts of a salicylic acid compound and a phenol (hereinafter referred to as a sulfurized hydroxybenzoate/phenate mixture) which mixture has a bright color and a high acid-neutralizing ability, while minimizing the number of steps and the amount of raw materials to be used.

The present inventors have found that a product having a greatly brightened color is obtained by modifying the process of U.S. Pat. No. 4,902,436 to conduct each of the following two steps: (1) adding a dihydric alcohol to perform a sulfurization reaction after the carboxylation step; and (2) adding an alkaline earth metal reagent, along with a dihydric alcohol if desired and necessary, to perform a further reaction after the carboxylation step.

The present inventors have also found that, besides the attainment of a brighter product color, the phenol recovered for reuse after the reaction can be prevented from being milky by (3) conducting the sulfurization reaction at a temperature of 160° C. or higher in an open system (a system in which the pressure inside the reaction vessel is kept constant) in the presence of a specific amount of a dihydric alcohol, in addition to condition (1) above. The present invention has been completed based on these findings.

The present invention provides:

(1) A process for producing a sulfurized hydroxybenzoate/phenate mixture which comprises reacting either a mixture of reactants comprising a phenol, a dihydric alcohol, and an alkaline earth metal reagent or a mixture of these reactants and water (metal addition reaction), subsequently distilling off water and the dihydric alcohol, reacting the resulting bottom with carbon dioxide, and then adding a dihydric alcohol and elemental sulfur to the resulting reaction product to conduct a sulfurization reaction;

(2) A process for producing a sulfurized hydroxybenzoate/phenate mixture which comprises reacting either a mixture of reactants comprising a phenol, a dihydric alcohol, and an alkaline earth metal reagent or a mixture of these reactants and water (first metal addition reaction), subsequently distilling off water and the dihydric alcohol, reacting the resulting bottom with carbon dioxide, adding to the resulting reaction product an alkaline earth metal reagent in an amount of up to 0.99 gram equivalent to the unreacted phenol present in the reaction product, reacting the resulting mixture in the presence of from 0.15 to 10 mol of a dihydric alcohol per mol of the alkaline earth metal reagent replenished (second metal addition reaction), subsequently distilling off water and part of the dihydric alcohol, and then reacting the resulting bottom with carbon dioxide, said second metal addition reaction being followed by a step in which elemental sulfur is added to and reacted with the reaction product;

(3)-1 A process for producing a sulfurized hydroxybenzoate/phenate mixture which comprises reacting either a mixture of reactants comprising a phenol, a dihydric alcohol, and an alkaline earth metal reagent or a mixture of these reactants and water (metal addition reaction), subsequently distilling off water and the dihydric alcohol, reacting the resulting bottom with carbon dioxide, and then adding a dihydric alcohol and elemental sulfur to the resulting reaction product to conduct sulfurization reaction, said sulfurization reaction being conducted at a temperature of 160° C. or higher in a pressurized open system with the amount of the dihydric alcohol added for the reaction being 1.8 mol or larger per mol of the alkaline earth metal reagent; and (3)-2 A process for producing a sulfurized hydroxybenzoate/phenate mixture which comprises reacting either a mixture of reactants comprising a phenol, a dihydric alcohol, and an alkaline earth metal reagent or a mixture of these reactants and water (metal addition reaction), subsequently distilling off water and the dihydric alcohol, reacting the resulting bottom with carbon dioxide, and then adding a dihydric alcohol and elemental sulfur to the resulting reaction product to conduct a sulfurization reaction, said sulfurization reaction being conducted at a temperature of 160° C. or higher in an atmospheric pressure open system with the amount of the dihydric alcohol added for the reaction being 0.3 mol or larger per mol of the alkaline earth metal reagent.

DETAILED DESCRIPTION OF THE INVENTION

Examples of the phenol to be used in the present invention include mono- or di-substituted phenols having a hydrocarbon side chain with 4 to 36, preferably 8 to 32, carbon atoms, e.g., an alkyl, alkenyl, or aralkyl group. For example, these phenols may be ones having hydrocarbon groups such as butyl, amyl, octyl, nonyl, dodecyl, cetyl, ethylhexyl, and triacontyl or ones having groups derived from petroleum hydrocarbons such as liquid paraffin, waxes, and olefin polymers (e.g., polyethylene, polypropylene, and polybutene). These may be used alone or as a mixture thereof. It is desirable to use a phenol capable of liquefying, usually at about 130° C., preferably at about 120° C. Specific examples of such phenols include butylphenol, octylphenol, nonylphenol, dodecylphenol, cetylphenol, and alkylphenols alkylated with polybutene, dinonylphenol, and didodecylphenol. Since these phenols are monobasic acids, one gram equivalent thereof is equal to one mol thereof.

The alkaline earth metal reagent to be used is usually an oxide or hydroxide of an alkaline earth metal. Examples thereof include oxides or hydroxides of calcium, barium, strontium, and magnesium. The reagent may, of course, be a mixture of these. One mol of the alkaline earth metal reagent is equal to two gram equivalents thereof. The amount of the alkaline earth metal reagent to be used is 0.99 equivalent or smaller, preferably from 0.01 to 0.98 equivalent, per equivalent of the phenol used.

In process (2) according to the present invention, the amount of the alkaline earth metal reagent to be used in the first metal addition reaction is about 0.99 equivalent or smaller, preferably about from 0.01 to 0.98 equivalent, per equivalent of the phenol used. With respect to the alkaline earth metal reagent to be used in the second metal addition reaction, it may be used in the same amount as the above per equivalent of the phenol and salicylic acid compound which are remaining unreacted after the reaction, i.e., remaining unconverted to metal salts (such phenol and salicylic acid compound being hereinafter referred to simply as "unreacted phenol"), whereby the desired sulfurized hydroxybenzoate/phenate mixture is obtained.

If the amount of the alkaline earth metal reagent relative to the phenol amount is too large, the desired product having good properties cannot be obtained, because the intermediate gels and hence the reaction does not proceed any longer. If the amount thereof is too small, not only does the product yield from the raw materials decrease, but also the recovery of the phenol is economically disadvantageous because of increased utility costs and much time required therefor.

As the dihydric alcohol, one which has a relatively low boiling point and viscosity and is highly reactive may be used. Preferred dihydric alcohols are ones having 2 to 6 carbon atoms, with ethylene glycol, propylene glycol, and the like being especially preferred. The dihydric alcohol assists the phenol in converting into an oil-soluble substance through reaction with the alkaline earth metal reagent.

In processes (1) to (3) according to the present invention, the (first) metal addition reaction may be conducted either in the presence of water, which has the effect of accelerating the reaction, or without the addition of water. In the case where water is added in carrying out the reaction, the preferred amount of the dihydric alcohol to be used is about from 0.15 to 3.0 mol, especially about from 0.3 to 1.5 mol, per mol of the alkaline earth metal reagent. In the case where water is not added in conducting the reaction, the preferred amount of the dihydric alcohol to be used is about from 1.0 to 3.0 mol, especially about from 1.2 to 2.0 mol, per mol of the alkaline earth metal reagent.

If the amount of the dihydric alcohol is too small, the conversions of the reactants, in particular the conversion of the alkaline earth metal reagent to an alkaline earth metal phenate, are lowered. The reduced conversions not only result in increased insoluble matter and hence a difficulty in filtration, but also lead to a low carboxylation degree in the subsequent carboxylation step to result in a low hydroxybenzoate yield. On the other hand, if the amount thereof is too large, the removal by distillation of the excess dihydric alcohol from the reaction product necessitates much time and increases utility costs, although the metal addition reaction of the phenol proceeds smoothly.

In the case where water is added to the reaction system in the step of metal addition reaction, in which a phenol is reacted with an alkaline earth metal reagent, in order to accelerate the reaction, any of various kinds of water can be used such as boiler water, industrial water, and the water formed by the metal addition reaction, not to mention distilled water. There is no particular limitation on water quality, and water in any state can be used such as cold water, warm water, steam, etc. The water for use in accelerating the metal addition reaction may be introduced alone into the reactor, or it may be introduced after part or all thereof is mixed with other raw materials such as the phenol or the dihydric alcohol. The time when water should be introduced into the reactor is not particularly limited and it may be either before or after the mixing of all the reactants except the water. It is, however, preferred to add water within about one hour from the mixing of all reactants.

In processes (1) to (3) according to the invention, the water for use in accelerating the metal addition reaction is introduced into the reaction system in an amount of about 0.01 to 10 mol, desirably about 0.1 to 2.0 mol, per mol of the alkaline earth metal reagent used.

The addition of water from outside into the reaction system enables the metal addition reaction to proceed more smoothly than reaction conducted under the same conditions except that water is not added. If the amount of water added to the reaction system is too small, the effect of water addition is reduced. On the other hand, if the amount thereof is too large, the advantage of simplifying the distillation step following the reaction is lost.

In process (1) according to the invention, the dihydric alcohol for use in the sulfurization reaction is added in an amount of preferably about 0.01 to 10 mol, especially about 0.1 to 5.0 mol, per mol of the alkaline earth metal reagent. If the dihydric alcohol is used in too large an amount, the removal of the excess dihydric alcohol from the reaction product by distillation requires much time and increased utility costs. If the amount thereof is too small, the desired product with a bright color cannot be obtained.

In process (2) according to the present invention, the dihydric alcohol to be used in the second metal addition reaction is about from 0.15 to 10 mol, preferably about from 0.5 to 5.0 mol, per mol of the alkaline earth metal reagent to be replenished.

The amount of the dihydric alcohol for use in the sulfurization reaction in process (3) according to the present invention is as follows. In the case of process (3)- 1, wherein the reaction is carried out in a pressurized open system, the amount of the dihydric alcohol is from 1.8 to 10 mols, preferably from 2.0 to 5.0 mols, per mol of the alkaline earth metal reagent. In the case of process (3)-2, wherein the reaction is conducted in an atmospheric pressure open system, the amount thereof is from 0.3 to 10 mols, preferably from 0.5 to 5.0 mols, per mol of the alkaline earth metal reagent. If the dihydric alcohol is used in too large an amount, the removal of the excess dihydric alcohol from the reaction product by distillation requires much time and leads to increased utility costs. If the dihydric alcohol is used in an amount below the lower limit specified above, the effect of preventing the recovered phenol from being milky cannot be obtained. The term "open system" herein means a system in which the pressure inside the reactor is regulated by gas evacuation or introduction in order to keep the inner pressure constant, which pressure otherwise varies with the progress of the reaction. For example, a pressurized open system of 5 atm means a system in which when the pressure inside the reactor exceeds 5 atm, it is reduced to 5 atm and when the pressure decreases below 5 atm, it is increased to 5 atm.

Sulfur can be used in a wide range of amounts, from an only slight amount to an exceedingly large amount. It is usually used in an amount of 0.1 to 4.0 mols, preferably 0.2 to 3.0 mols, more preferably 0.2 to 1.5 mols, per mol of the alkaline earth metal reagent. The viscosity of the product becomes lower as the amount of the sulfur used decreases. However, if the amount of the sulfur used is too small, the product has too low a sulfide content and impaired oil solubility. If the amount thereof is too large, not only does the product have reduced basicity and hence a product having a high total base number is difficult to obtain, but also the product disadvantageously has an extremely high viscosity.

Examples of inert gases that can be used in the sulfurization reaction include nitrogen and helium, with nitrogen gas being preferably used.

A diluent or solvent (hereinafter referred to as "diluent") having a suitable viscosity can be added in the present invention in order to facilitate the handling of reactants, intermediates, the final product, etc. For example, when the excess unreacted phenol is to be recovered by distillation from the reaction product after completion of the sulfurization reaction, a bottom in a preferred liquid state can be obtained by conducting the distillation in the presence of a diluent having a high boiling point and a suitable viscosity. It should be noted that since part of the diluent is also distilled off along with the unreacted phenol, use of a diluent which does not produce a direct adverse effect on the reaction is desirable if the phenol recovered is to be repeatedly used for reaction. The reaction may be conducted in the presence of a diluent. Preferred examples of the diluent include petroleum fractions having suitable viscosities, such as paraffinic, naphthenic, and aromatic oils and mixed base oils. Specific examples thereof include lubricating oil fractions having boiling points of about 220° to 550° C. and viscosities of about 0.5 to 40 cSt at 100° C. Other organic solvents can be used as the diluent if they are hydrophobic and lipophilic and do not produce an adverse effect on the reaction or on the use of the final product.

Operating conditions for the process of the present invention for producing a sulfurized hydroxybenzoate/phenate mixture are as follows.

(A) Metal Addition Step

A mixture of reactants comprising predetermined amounts of a phenol, a dihydric alcohol, and an alkaline earth metal reagent and, if desired, a diluent and/or the above-specified amount of water is reacted at a temperature in the range of from 60° to 200° C., preferably about from 90° to 190° C. This reaction is conducted at a reduced, atmospheric, or elevated pressure in the range of about from 0.01 to 11 atm.A (hereinafter abbreviated as "atm"). Prior to the subsequent carboxylation step, the water formed in this metal addition reaction and the water added for the reaction are distilled off until about 99.9% or more, preferably 100%, of the total water amount is removed, and the dihydric alcohol is distilled off until the amount of the dihydric alcohol remaining in the system decreases to usually about 0.6 mol or less, preferably about 0.3 mol or less, per mol of the alkaline earth metal reagent. If water and the dihydric alcohol remain in the system in large amounts, the subsequent carboxylation step results in a lowered degree of carboxylation to yield a hydroxybenzoate in a reduced amount. This metal addition reaction almost terminates within a time period of usually about from 1 to 9 hours.

(B) Carboxylation Step

This step is for carboxylating the product of the above metal addition reaction to obtain a hydroxybenzoate component. Illustratively stated, the product of the metal addition reaction is reacted with carbon dioxide at a temperature of about 150° to 240° C., preferably about 160° to 230° C., and at a reduced, atmospheric, or elevated pressure in the range of from about 0.05 to 100 atm, preferably about from 0.1 to 50 atm. This reaction almost terminates within a time period of usually about from 1 to 10 hours.

Since the steps following the above-described carboxylation step differ among processes (1) to (3) of the invention, they will be explained below with respect to each process.

(I) Processes (1) and (3) of the Invention (C) Sulfurization Step

This sulfurization step is for improving properties of the final product such as, in particular, oil solubility, viscosity characteristics, and storage stability. The addition of a dihydric alcohol prior to or during this sulfurization reaction enables the final product to have a brightened color. This reaction is conducted at a temperature of usually about 60° to 200° C., preferably 90° to 190° C., and at a reduced, atmospheric, or elevated pressure in the range of about from 0.01 to 11 atm. It is preferred to carry out the reaction in an inert gas atmosphere. This reaction almost terminates usually within about 1 to 20 hours (process (1) of the invention).

From the standpoint of preventing the phenol to be recovered for reuse from being milky, the sulfurization reaction should be carried out at atmospheric pressure or in a pressurized open system in the presence of a specific amount of a dihydric alcohol. Specifically, in the case of a pressurized open system, the reaction is conducted in the presence of not less than 1.8 mol of a dihydric alcohol per mol of the alkaline earth metal reagent; in the case of an atmospheric pressure open system, not less than 0.3 mol of a dihydric alcohol per mol of the alkaline earth metal reagent is allowed to be present in carrying out the reaction. By thus conducting the reaction, a final product having a brighter color is obtained and the recovered phenol can be prevented from being milky. The sulfurization reaction of the product of the above-described carboxylation reaction is conducted at a temperature of 160° C. or higher, preferably from 160° to 200° C., and a pressure of 1.0 to 10 atm, desirably in an inert gas atmosphere. It is preferred to carry out the reaction in an inert gas atmosphere. This reaction almost terminates usually within about 1 to 20 hours. If the reaction temperature is too high, carboxyl groups of the hydroxybenzoate yielded in the carboxylation step are decarboxylated disadvantageously. On the other hand, if the reaction temperature is too low, no improvement is attained in preventing the recovered phenol from being milky although a brighter product color is obtained, or the final product disadvantageously has a high viscosity, though the recovered phenol may be prevented from being milky. For obtaining a final product having a low viscosity, it is preferred to use a temperature of 160° C. or higher (process (3) of the invention).

It is possible to repeat the above-described metal addition reaction with an alkaline earth metal reagent and a dihydric alcohol being added to the product of the sulfurization reaction. In this case, a step of carbon dioxide treatment such as (D) described below can be repeatedly conducted after the metal addition reaction. By the carbon dioxide treatment, properties of the final product such as, in particular, oil solubility, viscosity characteristics, and storage stability can be improved and the total base number of the final product can be heightened.

(D) Step of Carbon Dioxide Treatment

In the case where the metal addition reaction is to be conducted two or more times as described above, each metal addition reaction may be followed by reaction with carbon dioxide which is carried out at a temperature of about 150° to 240° C., preferably about 160° to 230° C., and at a reduced, atmospheric, or elevated pressure in the range of about from 0.05 to 100 atm, preferably from 0.1 to 50 atm.

(II) Process (2) of the Invention (C) Step of Second Metal Addition Reaction

Although step (B) in processes (1) and (3) of the invention is followed by a sulfurization step, the second metal addition reaction is performed in process (2) of the invention prior to or simultaneous with the sulfurization step.

To the product of the above-described carboxylation reaction is added an alkaline earth metal reagent in an amount of up to 0.99 gram equivalent to the unreacted alkylphenol present in the reaction product. (Since 1 equivalent of the alkaline earth metal reagent reacts with 2 equivalents of the alkylphenol in this reaction system, when the amount of the alkylphenol added for the first metal addition step was 2 equivalents or larger per equivalent of the alkaline earth metal reagent, the excess alkylphenol remains unreacted in the system. This remainder therefore corresponds to the unreacted alkylphenol present in the reaction product.) Further, a dihydric alcohol is allowed to be present in the resulting mixture in an amount of about 0.15 to 10 mol, preferably about 0.5 to 5.0 mol, per mol of the alkaline earth metal reagent replenished. This mixture is reacted at a temperature of about 60° to 200° C., preferably about 90° to 190° C., and at a reduced, atmospheric, or elevated pressure in the range of about from 0.01 to 10 atm. Prior to the subsequent step of carbon dioxide treatment, the water formed in this step of metal addition reaction and the water added for the reaction are distilled off until about 80% or more, preferably 90% or more, of the total water amount is removed, and the dihydric alcohol is distilled off until the amount thereof remaining in the system decreases to usually about 0.5 to 5.0 mol per mol of the total alkaline earth metal reagent. If water and the dihydric alcohol remain in the system in large amounts, the final product will have low oil solubility and poor storage stability. If the residual dihydric alcohol amount is too small, the desired total base number cannot be obtained.

(D) Sulfurization Step

This sulfurization step is for improving properties of the final product such as, in particular, oil solubility, viscosity characteristics, and storage stability. This step is usually conducted simultaneously with the second metal addition reaction described above. It is, however, possible to perform this step either after the second metal addition reaction or simultaneously with or after the subsequent step of second carbon dioxide treatment. In particular, conducting this step prior to the second carbon dioxide treatment is effective in imparting a significantly brightened color to the final product.

Elemental sulfur is added for this sulfurization reaction in an amount of about 0.1 to 4.0 mol, preferably about 0.2 to 3.0 mol, per mol of the total alkaline earth metal reagent used, and the reaction is performed at a temperature of about 60° to 200° C., preferably about 90° to 190° C., in an inert gas or carbon dioxide gas atmosphere at a reduced, atmospheric, or elevated pressure in the range of from about 0.01 to 10 atm. This reaction almost terminates usually within about 1 to 20 hours.

(E) Step of Second Carbon Dioxide Treatment

This step is for stabilizing the product of the step of second metal addition reaction and for improving properties of the final product such as, in particular, oil solubility, viscosity characteristics, and storage stability. The product of the above-described step of second metal addition reaction is reacted with carbon dioxide at a temperature of about 150° to 240° C., preferably about 160° to 230° C., and at a reduced, atmospheric, or elevated pressure in the range of about from 0.05 to 100 atm, preferably about from 0.1 to 50 atm.

If desired, the steps of metal addition and carbon dioxide treatment may be repeated, whereby the total base number of the final product can be heightened further.

The following explanation applies to each of processes (1) to (3) of the invention.

It is preferred that the unreacted phenol remaining in the reaction product after the sulfurization reaction be partly or mostly recovered from the standpoints of cost and others. The recovered phenol may be reused as a raw material. When the distillation for recovering the unreacted phenol is conducted in the presence of an ordinary diluent such as a high-boiling mineral oil, a distillation residue in a preferred liquid state can be obtained. Any insoluble matter remaining in a small amount can be removed by filtration, centrifugal separation, etc., before or after phenol recovery.

Although the precise structure of the reaction product obtained by the process of the present invention has not been elucidated in detail, it is thought that part of the phenol used as a raw material has been converted to a salicylate through reaction with carbon dioxide, since both a salicylic acid compound and the phenol are detected in an oily layer obtained by hydrolyzing the reaction product and extracting the hydrolyzate with a solvent such as hexane. It is also thought that, since the reaction product contains an alkaline earth metal element in an amount larger than a theoretical amount calculated based on the total gram equivalent amount of the sum of the phenol and salicylic acid compound, the reaction product has the skeleton of either a basic alkaline earth metal salicylate or a basic alkaline earth metal salicylate sulfide and the skeleton of a basic alkaline earth metal phenate sulfide. However, details are unclear as to whether the reaction product is a mixture of a compound constituted of a salicylate skeleton alone and a compound constituted of a phenate skeleton alone, or is a compound having both a salicylate skeleton and a phenate skeleton in each molecule, or is a mixture containing both. Further, details are unclear of the mode of bonding of the reacted alkaline earth metal element, sulfur, and dihydric alcohol to the salicylate and phenate skeletons, and also unclear with respect to the mode of bonding, in the reaction product, of that part of the reacted carbon dioxide which has not been consumed by conversion to a salicylate. In any case, the reaction product obtained by the process of the present invention is a mixture of a sulfurized basic alkaline earth metal phenate and a sulfurized basic alkaline earth metal salicylate.

EXAMPLE 1

Into a 5-liter autoclave equipped with a stirrer, condenser, nitrogen gas-introducing tube, and thermometer were introduced 2,671 g (9.6 mol) of 94.4%-pure dodecylphenol and 175.7 g (3.0 mol) of 95.8%-pure calcium oxide. After the contents were stirred, 257.7 g (4.1 mol) of ethylene glycol containing 2.1 wt % water was added to the resulting suspension in a nitrogen stream at 155° C. and an elevated pressure of 3 atm. The resulting mixture was allowed to react at 160° C. for 3 hours. While the reaction system was then gradually evacuated, the water added, the water generated, most of the ethylene glycol added, and part of the dodecylphenol were distilled off, thereby obtaining 2,740.0 g of a liquid distillation residue of a mustard color. At the time when the distillation was completed, the temperature of the bottom was 180° C. and that of the distillate was 133° C. (2 mmHg).

Carbon dioxide was then blown in 2,740.0 g of the distillation residue placed under conditions of 180° C. and 2 mmHg, thereby to elevate the pressure to 5 atm. The residue was maintained in that state for 4 hours to obtain 2,840 g of a liquid reaction product of a dark grayish yellow red color. This product had a calcium content of 4.2 wt %. 2.0 Grams of this reaction product was placed in a separatory funnel, dissolved in 60 ml of ether, and hydrolyzed with 15 ml of 1N sulfuric acid (with stirring for 60 minutes with a shaker). After the resulting mixture was thoroughly washed with water, the ether layer was separated and the ether was removed with a rotary evaporator, thereby obtaining 1.9 g of a brown liquid. This liquid had a total acid number of 45.6 mgKOH/g (the measurement of acid number in the following examples was conducted likewise).

To a 1-liter autoclave was transferred 474.5 g of the product of the above carboxylation reaction. Thereto were added 5.9 g (0.1 mol) of 95.8%-pure calcium oxide, 32.4 g (0.5 mol) of ethylene glycol, 19.3 g (0.6 mol) of sulfur, and 132.3 g of neutral oil 150 (a paraffinic lubricating oil having a viscosity of 5.27 cSt at 100° C.) in a nitrogen stream at atmospheric pressure and 110° C. The resulting mixture was then stirred at that temperature for 3 hours, with the pressure in the reaction system being kept at 3 atm with nitrogen. While the reaction system was then gradually evacuated, the water generated and part of the ethylene glycol and dodecylphenol added were distilled off, thereby obtaining 653.0 g of a liquid product of a very dark yellowish red color. At the time when the distillation was completed, the temperature of the bottom was 128° C. and that of the distillate was 80° C. (5 mmHg).

Carbon dioxide was then blown in 653.0 g of the distillation residue placed under conditions of 150° C. and 5 mmHg, thereby to elevate the pressure to 5 atm. The residue was maintained in that state for 2 hours to obtain 660.3 g of a liquid reaction product of a dark grayish yellow red color.

In a 1-liter three-necked pear-shaped flask was placed 581.3 g of the product of the above sulfurization reaction, and the flask was sealed. Most of the ethylene glycol and dodecylphenol and a small portion of the lubricating oil fraction were distilled off to obtain 334.2 g of a distillation residue. The temperature of the final distillate was 193° C. (3 mmHg). The insoluble matter contained in a very slight amount in the distillation residue was removed by filtration, thereby obtaining 333.1 g of a final product as a clear viscous liquid of a very dark yellowish red color, which had the properties shown in Table 1.

This liquid had a total acid number of 36 mgKOH/g. The above result indicates the presence of carboxyl groups, i.e., the presence of a compound having a salicylate skeleton.

Color was measured in accordance with ASTM D 1500 as follows. A sample in an amount of 15 parts by volume was dissolved in 85 parts by volume of illuminating kerosine. The solution was transferred to an ASTM color comparison tube and the color was measured with an ASTM colorimeter. If the measured value of color is 8 or higher, this kerosine solution in an amount of 15 parts by volume is further dissolved in 85 parts by volume of illuminating kerosine to measure the color of the resulting solution. If this solution still has a color value of 8 or higher, the same procedure is repeated until the color value of the resulting solution is reduced to lower than 8 (this applies also to the following examples).

Compared to the final product of Comparative Example 1 that will be given later, the final product obtained above had a higher total base number and a far brighter color. The final product had a hydroxybenzoate component content which was 66.9% of the amount of the hydroxybenzoate component formed by carboxylation; this decrease of hydroxybenzoate component amount is far smaller than that in Comparative Example 1.

EXAMPLE 2

Into a 5-liter autoclave equipped with a stirrer, condenser, nitrogen gas-introducing tube, and thermometer were introduced 2,760 g (9.6 mol) of 91.4%-pure dodecylphenol and 175.7 g (3.0 mol) of 95.8%-pure calcium oxide. After the contents were stirred, 257.1 g (4.1 mol) of ethylene glycol containing 2.1 wt % water was added to the resulting suspension in a nitrogen stream at 155° C. and an elevated pressure of 5 atm. The resulting mixture was allowed to react at 160° C. for 3 hours. While the reaction system was then gradually evacuated, the water added, the water generated, most of the ethylene glycol added, and part of the dodecylphenol were distilled off, thereby obtaining 2,850.4 g of a liquid distillation residue of a mustard color. At the time when the distillation was completed, the temperature of the bottom was 178° C. and that of the distillate was 134° C. (2 mmHg).

Carbon dioxide was then blown in 2,850.4 g of the distillation residue placed under conditions of 178° C. and 2 mmHg, thereby to elevate the pressure to 5 atm. The residue was maintained in that state for 4 hours to obtain 2,950 g of a liquid reaction product of a dark grayish yellow red color. This product had a calcium content of 4.1 wt %. 2.0 Grams of this reaction product was placed in a separatory funnel and treated in the same manner as in Example 1, thereby obtaining 1.9 g of a brown liquid. This liquid had a total acid number of 46 mgKOH/g.

To a 1-liter autoclave was transferred 472.8 g of the product of the above carboxylation reaction. Thereto were added 28.2 g (0.5 mol) of 95.8%-pure calcium oxide, 149.7 g (2.4 mol) of ethylene glycol, 30.9 g (1.0 mol) of sulfur, and 94.8 g of neutral oil 150 (a paraffinic lubricating oil having a viscosity of 5.27 cSt at 100° C.) in a nitrogen stream at atmospheric pressure and 150° C. The resulting mixture was then stirred at that temperature for 3 hours, with the pressure in the reaction system being kept at 5 atm with nitrogen. While the reaction system was then gradually evacuated, the water generated and part of the ethylene glycol and dodecylphenol added were distilled off, thereby obtaining 655.4 g of a liquid product of a very dark yellowish red color. At the time when the distillation was completed, the temperature of the bottom was 150° C. and that of the distillate was 112° C. (32 mmHg).

Carbon dioxide was then blown in 649.3 g of the distillation residue placed under conditions of 150° C. and 32 mmHg, at a flow rate of 223 ml/min for about 0.5 hour. When the pressure had reached 1 atm, the temperature was raised to 180° C., after which carbon dioxide was blown again to elevate the pressure to 5 atm. The residue was maintained in that state for 2 hours to obtain 666.3 g of a liquid reaction product of a dark grayish yellow red color.

In a 1-liter three-necked pear-shaped flask was placed 481.4 g of the product of the above sulfurization reaction, and the flask was sealed. Most of the ethylene glycol and dodecylphenol and a small portion of the lubricating oil fraction were distilled off to obtain 317.3 g of a distillation residue. The temperature of the final distillate was 187° C. (3 mmHg). The insoluble matter contained in a very slight amount in the distillation residue was removed by filtration, thereby obtaining 316.0 g of a final product as a clear viscous liquid of a very dark yellowish red color, which had the properties shown in Table 1.

Compared to the final product of Comparative Example 1 that will be given below, the final product obtained above had a higher total base number and a far brighter color. The final product had a hydroxybenzoate component content which was 84.2% of the amount of the hydroxybenzoate component formed by carboxylation; this decrease of hydroxybenzoate component amount is far smaller than that in Comparative Example 1.

COMPARATIVE EXAMPLE 1

To a 1-liter autoclave was transferred 474.6 g of the product of carboxylation reaction yielded by the first carbon dioxide treatment in Example 1. Thereto were added 19.3 g (0.6 mol) of sulfur and 120.9 g of neutral oil 150 in a $CO_2$ stream at atmospheric pressure and 172° C. Subsequently, the temperature was raised to 180° C. and the pressure was elevated to 5 atm with $CO_2$. The contents were then allowed to react for 2 hours to obtain 610.6 g of a sulfurization reaction product.

In a 1-liter three-necked pear-shaped flask was placed 536.8 g of the reaction product obtained above, and the flask was sealed. Distillation and filtration were conducted in the same manner as in Example 1, thereby obtaining 306.9 g of a final product as a clear viscous liquid of a very dark yellowish red color, which had the properties shown in Table 1.

This Comparative Example 1 illustrates the process of U.S. Pat. No. 4,902,436 (1990), in which after carboxylation reaction, sulfurization reaction is conducted to obtain the final product without performing the second metal addition reaction. Compared to the final product of Example 1, the final product obtained above had a lower total base number and a darker color. The final product had a hydroxybenzoate component content which was 56.6% of the amount of the hydroxybenzoate component formed by carboxylation; this decrease of hydroxybenzoate component amount is large, as compared to that in Example 1.

EXAMPLE 3

Into a 5-liter autoclave equipped with a stirrer, condenser, nitrogen gas-introducing tube, and thermometer were introduced 695 g (3.0 mol) of 94.4%-pure nonylphenol and 96.2 g (1.0 mol) of 80%-pure calcium hydroxide. After the contents were stirred, 2.7 g of water and 93.2 g (1.5 mol) of ethylene glycol were added to the resulting suspension in a nitrogen stream at 125° C. and a pressure of 1 atm. The resulting mixture was allowed to react at 130° C. for 3 hours. While the reaction system was then gradually evacuated, the water added, the water generated, most of the ethylene glycol added, and part of the nonylphenol were distilled off, thereby obtaining 823.7 g of a liquid distillation residue of a mustard color. At the time when the distillation was completed, the temperature of the bottom was 180° C. and that of the distillate was 135° C. (4 mmHg).

Carbon dioxide was then blown in 823.7 g of the distillation residue placed under conditions of 180° C. and 4 mmHg, thereby to elevate the pressure to 5 atm. The residue was maintained in that state for 4 hours to obtain 854.5 g of a liquid reaction product of a dark grayish yellow red color. This product had a calcium content of 4.88 wt %. 2.0 Grams of this reaction product was placed in a separatory funnel and treated in the same manner as in Example 1, thereby obtaining 1.9 g of a brown liquid. This liquid had a total acid number of 55 mgKOH/g.

To a 2-liter autoclave was transferred 800.0 g of the product of the above carboxylation reaction. Thereto were added 90.0 g (1.0 mol) of 80%-pure calcium hydroxide, 145.3 g (2.3 mol) of ethylene glycol, 36.1 g (1.1 mol) of sulfur, and 183.8 g of neutral oil 150 (a paraffinic lubricating oil having a viscosity of 5.27 cSt at 100° C.) in a nitrogen stream at atmospheric pressure and 150° C. The resulting mixture was then stirred at that temperature for 3 hours, with the pressure in the reaction system being kept at 3 atm with nitrogen. While the reaction system was then gradually evacuated, the water generated and part of the ethylene glycol and nonylphenol added were distilled off, thereby obtaining 1,117.3 g of a liquid product of a very dark yellowish red color. At the time when the distillation was completed, the temperature of the bottom was 148° C. and that of the distillate was 113° C. (25 mmHg).

Carbon dioxide was then blown in 1,117.3 g of the distillation residue placed under conditions of 150° C. and 25 mmHg, at a flow rate of 200 ml/min for about 0.5 hour. When the pressure had reached 1.5 atm, the temperature was raised to 180° C., after which carbon dioxide was blown again to elevate the pressure to 5 atm. The residue was maintained in that state for 2 hours to obtain 1,146.1 g of a liquid reaction product of a dark grayish yellow red color.

In a 2-liter three-necked pear-shaped flask was placed 1,000.0 g of the product of the above sulfurization reaction, and the flask was sealed. Most of the ethylene glycol and nonylphenol and a small portion of the lubricating oil fraction were distilled off to obtain 736.5 g of a distillation residue. The temperature of the final distillate was 168° C. (2 mmHg). The insoluble matter contained in a very slight amount in the distillation residue was removed by filtration, thereby obtaining 695.7 g of a final product as a clear viscous liquid of a very dark yellowish red color, which had the properties shown in Table 1.

EXAMPLE 4

Into a 5-liter autoclave equipped with a stirrer, condenser, nitrogen gas-introducing tube, and thermometer were introduced 2,446 g (11.1 mol) of nonylphenol and 173.1 g (3.0 mol) of 97.2%-pure calcium oxide. After the contents were stirred, 316.7 g (5.1 mol) of ethylene glycol was added to the resulting suspension in a nitrogen stream at atmospheric pressure and 125° C. The resulting mixture was allowed to react at 130° C. for 5 hours. While the reaction system was then gradually evacuated, the water added, the water generated, most of the ethylene glycol added, and part of the nonylphenol were distilled off, thereby obtaining 2,207.9 g of a liquid distillation residue of a mustard color. At the time when the distillation was completed, the temperature of the bottom was 180° C. and that of the distillate was 151° C. (7 mmHg).

Carbon dioxide was then blown in 2,207.9 g of the distillation residue placed under conditions of 180° C. and 7 mmHg, thereby to elevate the pressure to 5 atm. The residue was maintained in that state for 4 hours to obtain 2,310 g of a liquid reaction product of a dark grayish yellow red color. This product had a calcium content of 5.2 wt %. 2.0 Grams of this reaction product was placed in a separatory funnel and treated in the same manner as in Example 1, thereby obtaining 1.9 g of a brown liquid. This liquid had a total acid number of 57.8 mgKOH/g.

To a 1-liter autoclave was transferred 424.0 g of the product of the above carboxylation reaction. Thereto were added 16.0 g (0.3 mol) of 97.2%-pure calcium oxide, 86.1 g (1.4 mol) of ethylene glycol, and 17.8 g (0.6 mol) of sulfur in a nitrogen stream at atmospheric pressure and 170° C. The resulting mixture was then stirred in a nitrogen atmosphere at that temperature and atmospheric pressure for 3 hours. While the reaction system was then gradually evacuated, the water generated and part of the ethylene glycol and nonylphenol added were distilled off, thereby obtaining 471.8 g of a liquid product of a very dark yellowish red color. At the time when the distillation was completed, the temperature of the bottom was 170° C. and that of the distillate was 90° C. (12 mmHg).

After 467.4 g of this distillation residue placed under conditions of 170° C. and 12 mmHg was then heated to 180° C., carbon dioxide was blown therein to elevate the pressure to 5 atm. The residue was maintained in that state for 2 hours to obtain 477.5 g of a liquid reaction product of a dark grayish yellow red color.

In a 1-liter three-necked pear-shaped flask were placed 385.3 g of the product of the above sulfurization reaction and 87.9 g of neutral oil 150 (a paraffinic lubricating oil having a viscosity of 5.27 cSt at 100° C.), and the flask was sealed. Most of the ethylene glycol and nonylphenol and a small portion of the lubricating oil fraction were distilled off to obtain 284.6 g of a distillation residue. The temperature of the final distillate was 198° C. (2 mmHg). The insoluble matter contained in a very slight amount in the distillation residue was removed by filtration, thereby obtaining 281.7 g of a final product as a clear viscous liquid of a very dark yellowish red color, which had the properties shown in Table 1.

Compared to the final product of Comparative Example 2 that will be given later, the final product obtained above had a higher total base number and a far brighter color. The final product had a hydroxybenzoate component content which was 65.4% of the amount of the hydroxybenzoate component formed by carboxylation; this decrease of hydroxybenzoate component amount is far smaller than that in Comparative Example 2.

EXAMPLE 5

To a 1-liter autoclave was transferred 434.3 g of the product of the first carbon dioxide treatment obtained in Example 4. Thereto were added 16.1 g (0.3 mol) of 97.2%-pure calcium oxide and 86.9 g (1.4 mol) of ethylene glycol in a nitrogen stream at atmospheric pressure and 170° C. Subsequently, the resulting mixture was stirred at that temperature for 5 hours, with the pressure in the reaction system being kept at 3 atm with nitrogen. While the reaction system was then gradually evacuated, the water generated and part of the ethylene glycol and nonylphenol added were distilled off, thereby obtaining 468.4 g of a liquid product of a very dark yellowish red color. At the time when the distillation was completed, the temperature of the bottom was 170° C. and that of the distillate was 86° C. (14 mmHg).

To 468.4 g of the thus-obtained distillation residue were then added 26.9 g (0.8 mol) of sulfur and 109.9 g of neutral oil 150 (a paraffinic lubricating oil having a viscosity of 5.27 cSt at 100° C.). The resulting mixture was allowed to react at 180° C. and 5 atm for 4 hours to obtain 592.7 g of a sulfurization product.

Carbon dioxide was then blown in 531.0 g of the sulfurization reaction product placed under conditions of 150° C. and 80 mmHg, at a flow rate of 220 ml/min for about 0.5 hour. When the pressure had reached 3.8 atm, the temperature was raised to 180° C., after which carbon dioxide was blown again to elevate the pressure to 5 atm. The reaction system was maintained in that state for 2 hours to obtain 538.7 g of a liquid reaction product of a dark grayish yellow red color.

In a 1-liter three-necked pear-shaped flask was placed 405.8 g of the reaction product obtained above, and the flask was sealed. Distillation and filtration were conducted in the same manner as in Example 4, thereby obtaining 273.9 g of a final product as a clear viscous liquid of a very dark yellowish red color, which had the properties shown in Table 1.

TABLE 1

| | Ex. 1 | Ex. 2 | Comp. Ex. 1 | Ex. 3 | Ex. 4 | Ex. 5 |
|---|---|---|---|---|---|---|
| Viscosity (100° C., cst) | 220.8 | 794 | 666.3 | 218.3 | 323.1 | 473.1 |
| Total base number (mgKOH/g) | 170 | 235 | 153 | 200 | 252 | 219 |
| Calcium (wt %) | 6.0 | 8.3 | 5.5 | 7.1 | 8.8 | 7.7 |
| Sulfur (wt %) | 2.9 | 3.9 | 3.3 | 2.3 | 3.0 | 3.8 |
| Total acid number (mgKOH/g) | 36 | 39 | 33 | 35 | 43 | 45 |
| Color (ASTM D 1500) | 8.0 | L3.0 | L4.0** | L8.0* | 6.0 | L5.5 |

*: DIL[2]
**: DIL[3]

EXAMPLE 6

Into a 5-liter autoclave equipped with a stirrer, condenser, nitrogen gas-introducing tube, and thermometer were introduced 2,501.0 g (9.0 mol) of 94.4%-pure dodecylphenol, 180.6 g (3.0 mol) of 93.2%-pure calcium oxide, and 336.8 g of neutral oil 150 (a paraffinic lubricating oil having a viscosity of 5.27 cSt at 100° C.). After the contents were stirred, a solution prepared by mixing 251.5 g (4.1 mol) of ethylene glycol with 5.4 g (0.3 mol) of ion-exchanged water was added to the resulting suspension in a nitrogen stream at 130° C. and an elevated pressure of 1.5 atm over a period of 30 minutes. After completion of the addition, the pressure in the reaction system was elevated to 3.0 atm with nitrogen and the mixture was allowed to react at 130° C. for 3 hours. While the reaction system was then gradually evacuated, 70.0 g of the water generated, most of the ethylene glycol added, a small portion of the lubricating oil fraction, and a small portion of the dodecylphenol, 608.2 g, were distilled off, thereby obtaining 2,600.0 g of a liquid distillation residue of a mustard color. At the time when the distillation was completed, the temperature of the bottom was 178° C. and that of the distillate was 136° C. (1 mmHg).

Carbon dioxide was then blown in 2,600.0 g of the distillation residue placed under conditions of 178° C. and 1 mmHg, thereby to elevate the pressure to 5.0 atm. The residue was thereafter maintained in that state for 4 hours to obtain 2,720.0 g of a liquid reaction product of a dark grayish yellow red color.

To a 1-liter autoclave was transferred 451.1 g of the product of the above carboxylation reaction. Sulfur was added thereto at 106° C. in an amount of 17.6 g (0.55 mol; 1.1 mol per mol of the alkaline earth metal reagent), and the pressure in the reaction system was elevated to 2.0 atm with nitrogen. Subsequently, 30.9 g (0.5 mol; 1.0 mol per mol of the alkaline earth metal reagent) of ethylene glycol was added thereto at 150° C. over a period of 30 minutes, and the pressure was elevated to 5.0 atm with nitrogen. The resulting mixture was stirred at 165° C. for 4 hours in an open system.

To the resulting reaction product was added 108.9 g of neutral oil 150 (a paraffinic lubricating oil having a viscosity of 5.27 cSt at 100° C.). After this mixture was stirred, 514.2 g thereof was transferred to a 1-liter three-necked pear-shaped flask, and most of the ethylene glycol and dodecylphenol and a small portion of the lubricating oil fraction, 212.5 g, were distilled off to obtain 294.3 g of a distillation residue. The temperature of the final distillate was 178° C. (4 mmHg). The insoluble matter contained in a very slight amount in the distillation residue was then removed by filtration, thereby obtaining 290.2 g of a final product as a clear viscous liquid of a very dark yellowish red color. General properties of this final product are shown in Table 1.

COMPARATIVE EXAMPLE 2

To a 1-liter autoclave was transferred 482.6 g of the product of carboxylation reaction obtained in Example 6. Sulfur was added thereto at 106° C. in an amount of 17.6 g (0.55 mol; 1.1 mol per mol of the alkaline earth metal reagent), and the pressure in the reaction system was then elevated to 5.0 atm with nitrogen. The resulting mixture was stirred at 165° C. for 4 hours in an open system.

To the resulting reaction product was added 115.6 g of neutral oil 150 (a paraffinic lubricating oil having a viscosity of 5.27 cSt at 100° C.). After this mixture was stirred, 492.3 g thereof was transferred to a 1-liter three-necked pear-shaped flask, and most of the ethylene glycol and dodecylphenol and a small portion of the lubricating oil fraction, 232.2 g, were distilled off to obtain 232.1 g of a distillation residue. The temperature of the final distillate was 198° C. (2 mmHg). The insoluble matter contained in a very slight amount in the distillation residue was then removed by filtration, thereby obtaining 228.7 g of a final product as a clear viscous liquid of a very dark yellowish red color. General properties of this final product are shown in Table 2.

In this Comparative Example 2, ethylene glycol was not added for the sulfurization reaction.

EXAMPLE 7

Into a 5-liter autoclave equipped with a stirrer, condenser, nitrogen gas-introducing tube, and thermometer were introduced 2,917.8 g (10.5 mol) of 94.4%-pure dodecylphenol and 246.7 g (3.0 mol) of 90.0%-pure calcium hydroxide. After the contents were stirred, 251.0 g (4.0 mol) of ethylene glycol was added to the resulting suspension in a nitrogen stream at 130° C. and an elevated pressure of 1.5 atm over a period of 30 minutes. After completion of the addition, the pressure in the reaction system was elevated to 3.0 atm with nitrogen and the mixture was allowed to react at 130° C. for 3 hours. While the reaction system was then gradually evacuated, 108.2 g of the water generated, most of the ethylene glycol added, and a small portion of the dodecylphenol, 305.2 g, were distilled off, thereby obtaining 2,992.1 g of a liquid distillation residue of a mustard color. At the time when the distillation was completed, the temperature of the bottom was 178° C. and that of the distillate was 119° C. (3 mmHg).

Carbon dioxide was then blown in 2,835.2 g of the distillation residue placed under conditions of 178° C. and 3 mmHg, thereby to elevate the pressure to 5.0 atm. The residue was thereafter maintained in that state for 4 hours to obtain 3,102.1 g of a liquid reaction product of a dark grayish yellow red color.

To a 1-liter autoclave was transferred 498.2 g of the product of the above carboxylation reaction. Sulfur was added thereto at 100° C. in an amount of 17.5 g (0.55 mol; 1.1 mol per mol of the alkaline earth metal reagent). Subsequently, 46.3 g (0.75 mol; 1.5 mol per mol of the alkaline earth metal reagent) of ethylene glycol was added thereto and the pressure was then elevated to 5.0 atm with nitrogen. The resulting mixture was stirred at 165° C. for 4 hours in an open system.

To the resulting reaction product was added 164.2 g of neutral oil 150 (a paraffinic lubricating oil having a viscosity of 5.27 cSt at 100° C.). After this mixture was stirred, 671.2 g thereof was transferred to a 1-liter three-necked pear-shaped flask, and most of the ethylene glycol and dodecylphenol and a small portion of the lubricating oil fraction, 369.5 g, were distilled off to obtain 295.2 g of a distillation residue. The temperature of the final distillate was 198° C. (2 mmHg). The insoluble matter contained in a very slight amount in the distillation residue was then removed by filtration, thereby obtaining 291.8 g of a final product as a clear viscous liquid of a very dark yellowish red color. General properties of this final product are shown in Table 2.

EXAMPLE 8

Into a 5-liter autoclave equipped with a stirrer, condenser, nitrogen gas-introducing tube, and thermometer were introduced 2,426.5 g (10.5 mol) of 95.2%-pure nonylphenol and 180.6 g (3.0 mol) of 93.2%-pure calcium oxide. After the contents were stirred, a solution prepared by mixing 251.5 g (4.1 mol) of ethylene glycol with 5.4 g (0.3 mol) of ion-exchanged water was added to the resulting suspension in a nitrogen stream at 130° C. and an elevated pressure of 1.5 atm over a period of 30 minutes. After completion of the addition, the pressure in the reaction system was elevated to 3.0 atm with nitrogen and the mixture was allowed to react at 130° C. for 3 hours. While the pressure in the reaction system was then gradually evacuated, 60.2 g of the water generated, most of the ethylene glycol added, and a small portion of the nonylphenol, 318.2 g, were distilled off, thereby obtaining 2,475.1 g of a distillation residue of a mustard color. At the time when the distillation was completed, the temperature of the bottom was 175° C. and that of the distillate was 108° C. (3 mmHg).

Carbon dioxide was then blown in 2,475.1 g of the distillation residue placed under conditions of 173° C. and 3 mmHg, thereby to elevate the pressure to 5.0 atm. The residue was thereafter maintained in that state for 4 hours to obtain 2,596.2 g of a liquid reaction product of a dark grayish yellow red color.

To a 1-liter autoclave was transferred 502.5 g of the product of the above carboxylation reaction. Sulfur was added thereto at 100° C. in an amount of 17.5 g (0.55 mol; 1.1 mol per mol of the alkaline earth metal reagent). Subsequently, 61.6 g (1.0 mol; 2.0 mol per mol of the alkaline earth metal reagent) of ethylene glycol was added thereto at 150° C. and atmospheric pressure over a period of 30 minutes, and the resulting mixture was stirred for 4 hours in a nitrogen stream (15 ml/min).

To the resulting reaction product was added 164.2 g of neutral oil 150 (a paraffinic lubricating oil having a viscosity of 5.27 cSt at 100° C.). After this mixture was stirred, 659.2 g thereof was transferred to a 1-liter three-necked pear-shaped flask, and most of the ethylene glycol and nonylphenol and a small portion of the lubricating oil fraction, 352.2 g, were distilled off to obtain 301.3 g of a distillation residue. The temperature of the final distillate was 190° C. (2 mmHg). The insoluble matter contained in a very slight amount in the distillation residue was then removed by filtration, thereby obtaining 298.2 g of a final product as a clear viscous liquid of a very dark yellowish red color. General properties of this final product are shown in Table 2.

TABLE 2

| | Ex. 6 | Comp. Ex. 2 | Ex. 7 | Ex. 8 |
|---|---|---|---|---|
| Viscosity (100° C., cst) | 295.3 | 525.1 | 220.8 | 212.1 |
| Total base number (mgKOH/g) | 159 | 168 | 170 | 168 |
| Calcium (wt %) | 5.8 | 6.1 | 6.0 | 6.1 |
| Sulfur (Wt%) | 3.1 | 2.9 | 2.9 | 2.9 |
| Total acid number (mgKOH/g) | 34 | 38 | 36 | 38 |
| Color (ASTM D 1500) | L7.5 | L2.0** | 8.0 | 8.0 |
| Solubility (*1) | Dissolved | Dissolved | Dissolved | Dis-solved |

**: DIL[3]

*1: Solubility in Middle East paraffinic engine oil 50, as measured with 5-min stirring at 60° C.

As Table 2 shows, the final products obtained in the Examples have far brighter colors than that obtained in the Comparative Example.

EXAMPLE 9

Into a 5-liter autoclave equipped with a stirrer, condenser, nitrogen gas-introducing tube, and thermometer were introduced 2,917.8 g (10.5 mol) of 94.4%-pure dodecylphenol and 175.7 g (3.0 mol) of 95.8%-pure calcium oxide. After the contents were stirred, a solution prepared by mixing 251.5 g (4.1 mol) of ethylene glycol with 5.4 g (0.3 mol) of ion-exchanged water was added to the resulting suspension in a nitrogen stream at 130° C. and an elevated pressure of 2.0 atm over a period of 30 minutes. After completion of the addition, the pressure in the reaction system was elevated to 3.0 atm with nitrogen and the mixture was allowed to react at 130° C. for 3 hours. While the pressure in the reaction system was then gradually evacuated, the water added, the water generated, most of the ethylene glycol added, and a small portion of the dodecylphenol, 510.5 g, were distilled off, thereby obtaining 2,830.9 g of a distillation residue of a mustard color. At the time when the distillation was completed, the temperature of the bottom was 173° C. and that of the distillate was 139° C. (2 mmHg).

Carbon dioxide was then blown in 2,830.9 g of the distillation residue placed under conditions of 178° C. and 3 mmHg, thereby to elevate the pressure to 5.0 atm. The residue was thereafter maintained in that state for 4 hours to obtain 2,940 g of a liquid reaction product of a dark grayish yellow red color.

To a 1-liter autoclave was transferred 490.0 g of the product of the above carboxylation reaction. Sulfur was added thereto at 105° C. in an amount of 17.7 g (0.55 mol; 1.1 mol per mol of the alkaline earth metal reagent). The reaction system was then heated to 150° C. and the pressure in the system was elevated to 2.0 atm with nitrogen. Subsequently, 62.1 g (1.0 mol; 2.0 mol per mol of the alkaline earth metal reagent) of ethylene glycol was added thereto over a period of 30 minutes. The temperature of the system was then raised to 165° C., and thereafter the resulting mixture was stirred for 4 hours in an open system, with the pressure being kept at 5.0 atm with nitrogen.

To the resulting reaction product was added 165.5 g of neutral oil 150 (a paraffinic lubricating oil having a viscosity of 5.27 cSt at 100° C.; the same neutral oil 150 was used in the following examples). After this mixture was stirred, 649.5 g thereof was transferred to a 1-liter three-necked pear-shaped flask, and most of the ethylene glycol and dodecylphenol and a small portion of the lubricating oil fraction, 355.9 g, were distilled off to obtain 286.8 g of a distillation residue. The temperature of the final distillate was 200° C. (2.5 mmHg). The insoluble matter contained in a very slight amount in the distillation residue was then removed by filtration, thereby obtaining 284.8 g of a final product as a clear viscous liquid of a very dark yellowish red color. General properties of this final product are shown in Table 3. The turbidity of the phenol recovered was visually judged (the same applies to the following examples).

REFERENCE EXAMPLE 1

The same procedures as in Example 9 were conducted except that ethylene glycol was added in an amount of 1.5 mol per mol of the alkaline earth metal reagent to perform the sulfurization reaction. Properties of the final product thus obtained are shown in Table 3.

Although this Reference Example 1 can be an example of process (1) of the present invention, it has been given as a reference example to be used as a comparative example for process (3) of the invention so as to demonstrate the effect of preventing the recovered phenol from being milky, which effect is an object of process (3) of the invention.

The final product obtained had the same color as that of Example 9, but the phenol recovered was turbid.

REFERENCE EXAMPLE 2

The same procedures as in Example 9 were conducted except that the sulfurization reaction was performed at 170° C. in a pressurized closed system. Properties of the final product obtained are shown in Table 3.

The final product had the same color as that of Example 9, but the phenol recovered was turbid.

REFERENCE EXAMPLE 3

The same procedures as in Example 9 were conducted except that the sulfurization reaction was performed at 150° C. Properties of the final product obtained are shown in Table 3.

The results show that lowering the sulfurization temperature causes the recovered phenol to be turbid.

EXAMPLE 10

To a 1-liter autoclave was transferred 490.0 g of the product of carboxylation reaction obtained in Example 9. Sulfur was added thereto at 103° C. in an amount of 17.7 g (0.55 mol; 1.1 mol per mol of the alkaline earth metal reagent). The reaction system was then heated to 150° C. and the pressure in the system was elevated to 3 atm with nitrogen. Subsequently, 62.1 g (1.0 mol; 2.0 mol per mol of the alkaline earth metal reagent) of ethylene glycol was added thereto over a period of 30 minutes. The temperature of the system was then raised to 178° C., and thereafter the resulting mixture was stirred for 4 hours in an open system, with the pressure being kept at 5.0 atm with nitrogen.

To the resulting reaction product was added 165.5 g of neutral oil 150. After this mixture was stirred, 649.9 g thereof was transferred to a 1-liter three-necked pear-shaped flask, and most of the ethylene glycol and dodecylphenol and a small portion of the lubricating oil fraction, 354.6 g, were distilled off to obtain 292.5 g of a distillation residue. The temperature of the final distillate was 198° C. (2 mmHg). The insoluble matter contained in a very slight amount in the distillation residue was then removed by filtration, thereby obtaining 288.4 g of a final product as a clear viscous liquid of a very dark yellowish red color. General properties of this final product are shown in Table 3.

In this Example 10, the sulfurization reaction was conducted in a pressurized open system at 178° C. As Table 3 shows, the final product had a bright color and the phenol recovered was not turbid.

TABLE 3

| | Ex. 9 | Ref. Ex. 1 | Ref. Ex. 2 | Ex. 10 | Ref. Ex. 3 |
|---|---|---|---|---|---|
| Viscosity (100° C., cst) | 225.0 | 284.2 | 76.9 | 150.7 | 661.1 |
| Total base number (mgKOH/g) | 170 | 172 | 172 | 166 | 166 |
| Calcium (wt %) | 6.02 | 6.22 | 5.95 | 5.95 | 5.92 |
| CO2 (*1) (wt %) | 2.21 | 2.11 | 3.06 | 3.09 | 1.30 |
| Sulfur (wt %) | 3.08 | 3.16 | 2.61 | 2.54 | 2.90 |
| Total acid number (mgKOH/g) | 27 | 38 | 33 | 17 | 32 |
| Color (ASTM D 1500) | L8.0 DIL | L8.0 DIL | L8.0 DIL | L6.0 DIL | 3.5 DIL2 |
| Turbidity of recovered phenol (*2) | O | X | X | O | X |

*1: exclusive of the carboxyl group of salicylic acid
*2: O = no turbidity; X = turbid

EXAMPLE 11

Into a 5-liter autoclave equipped with a stirrer, condenser, nitrogen gas-introducing tube, and thermometer were introduced 2,917.8 g (10.5 mol) of 94.4%-pure dodecylphenol and 180.6 g (3.0 mol) of 93.2%-pure calcium oxide. After the contents were stirred, a solution prepared by mixing 251.5 g (4.1 mol) of ethylene glycol with 5.4 g (0.3 mol) of ion-exchanged water was added to the resulting suspension in a nitrogen stream at 130° C. and an elevated pressure of 1.5 atm over a period of 30 minutes. After completion of the addition, the pressure in the reaction system was elevated to 3.0 atm with nitrogen and the mixture was allowed to react at 130° C. for 3 hours. While the reaction system was then gradually evacuated, the water added, the water generated, most of the ethylene glycol added, and a small portion of the dodecylphenol, 385.0 g, were distilled off, thereby obtaining 2,965.2 g of a liquid distillation residue of a mustard color. At the time when the distillation was completed, the temperature of the bottom was 173° C. and that of the distillate was 109° C. (3 mmHg).

Carbon dioxide was then blown in 2,965.2 g of the distillation residue placed under conditions of 178° C. and 3 mmHg, thereby to elevate the pressure to 5.0 atm. The residue was thereafter maintained in that state for 4 hours to obtain 3,085 g of a liquid reaction product of a dark grayish yellow red color.

To a 1-liter autoclave was transferred 503.7 g of the product of the above carboxylation reaction. Sulfur was added thereto at 106° C. in an amount of 17.3 g (0.54 mol; 1.1 mol per mol of the alkaline earth metal reagent). The reaction system was then heated to 150° C. in a 15 ml/min nitrogen stream, and 15.2 g (0.25 mol; 0.5 mol per mol of the alkaline earth metal reagent) of ethylene glycol was added thereto over a period of 30 minutes. Subsequently, the temperature of the system was raised to 165° C. and the resulting mixture was stirred for 4 hours in a 15 ml/min nitrogen stream in an atmospheric pressure open system.

To the resulting reaction product was added 162.1 g of neutral oil 150. After this mixture was stirred, 581.9 g thereof was transferred to a 1-liter three-necked pear-shaped flask, and most of the ethylene glycol and dodecylphenol and a small portion of the lubricating oil fraction, 301.1 g, were distilled off to obtain 274.2 g of a distillation residue. The temperature of the final distillate was 191° C. (2 mmHg). The insoluble matter contained in a very slight amount in the distillation residue was then removed by filtration, thereby obtaining 268.6 g of a final product as a clear viscous liquid of a very dark yellowish red color. General properties of this final product are shown in Table 4.

In this Example 11, the sulfurization reaction was conducted in an atmospheric pressure open system, with the amount of ethylene glycol added being 0.5 mol per mol of the alkaline earth metal reagent.

EXAMPLE 12

To a 1-liter autoclave was transferred 510.3 g of the product of carboxylation reaction obtained in Example 11. Sulfur was added thereto at 100° C. in an amount of 17.5 g (0.55 mol; 1.1 mol per mol of the alkaline earth metal reagent). The reaction system was then heated to 150° C. in a 15 ml/min nitrogen stream, and 61.6 g (1.0 mol; 2.0 mol per mol of the alkaline earth metal reagent) of ethylene glycol was added thereto over a period of 30 minutes. Subsequently, the temperature of the system was raised to 178° C. and the resulting mixture was stirred for 4 hours in a 15 ml/min nitrogen stream in an atmospheric pressure open system.

To the resulting reaction product was added 164.2 g of neutral oil 150. After this mixture was stirred, 635.2 g thereof was transferred to a 1-liter three-necked pear-shaped flask, and most of the ethylene glycol and dodecylphenol and a small portion of the lubricating oil fraction, 354.9 g, were distilled off to obtain 278.0 g of a distillation residue. The temperature of the final distillate was 197° C. (2 mmHg). The insoluble matter contained in a very slight amount in the distillation residue was then removed by filtration, thereby obtaining 269.8 g of a final product as a clear viscous liquid of a very dark yellowish red color. General properties of this final product are shown in Table 4.

In this Example 12, the sulfurization reaction was conducted in an atmospheric pressure open system at 178° C., with the amount of ethylene glycol added being 2.0 mol per mol of the alkaline earth metal reagent. The phenol recovered was not turbid, but the final product had a slightly low total acid number due to the slightly high reaction temperature.

REFERENCE EXAMPLE 4

The same procedures as in Example 11 were conducted except that the sulfurization reaction was performed at 150° C., with the amount of ethylene glycol added being 2.0 mol per mol of the alkaline earth metal reagent. Properties of the final product obtained are shown in Table 4.

The phenol recovered was turbid, although the final product had a high total acid number due to the low reaction temperature.

TABLE 4

| | Ex. 11 | Ex. 12 | Ref Ex. 4 |
|---|---|---|---|
| Viscosity (100° C., cst) | 134.0 | 284.6 | 568.0 |
| Total base number (MgKOH/g) | 168 | 166 | 165 |
| Calcium (wt %) | 5.81 | 5.92 | 5.94 |
| CO2 (*1) (wt %) | 0.83 | 1.95 | 1.37 |
| Sulfur (wt %) | 4.34 | 3.07 | 2.87 |
| Total acid number (MgKOH/g) | 33 | 18 | 39 |
| Color (ASTM D 1500) | L8.0 DIL | L4.5 DIL | L3.5 DIL2 |
| Turbidity of recovered phenol (*2) | O | O | X |

*1: exclusive of the carboxyl group of salicylic acid
*2: O = no turbidity; X = turbid According to the present invention, in which an alkaline earth metal reagent is used for a reaction step in place of an alkali metal reagent and which employs relatively simple process steps and smaller amounts of raw materials without using a halide as sulfurizing reagent, a mixture of alkaline earth metal salts of a salicylic acid compound and a phenol can be easily produced in good yield based on the metal used despite those limitations, which mixture has usually been able to be obtained only when an alkali metal compound and a sulfur halide are used in a complicated process. The final product produced by the present invention not only has advantages of the product of the process of the aforementioned U.S. Pat. No. 4,902,436, e.g., it shows excellent oil solubility even when an alkylphenol in which the alkyl had about 9 carbon atoms at the most was used as a raw material, but also can have an improved color as compared with the product of that invented process. In the Reiff process described hereinabove, use of an alkylphenol in which the alkyl has at least 20 carbon atoms is requisite for obtaining oil solubility. Another advantage of the present invention is that it is easy to produce a complex comprising 1 mol of an alkaline earth metal per 1 mol of a hydroxybenzoate formed by carboxylation reaction. This complex has conventionally been synthesized by a complicated process in which either an alkylsalicylic acid or a normal salt obtained by the Kolbe-Schmitt process, i.e., a monosodium salt, is converted to the corresponding disodium salt and it is then metathetically reacted with an alkaline earth metal halide (see A. Strang, U.S. Pat. No. 3,704,315 (1972)).

Furthermore, by employing specific reaction conditions as in process (3) of the invention, not only the color of the mixture of a sulfurized alkaline earth metal salicylate and phenate can be made far brighter than those of conventional products, but also the unreacted phenol recovered is reusable because it is prevented from being milky. Since phenols are expensive and used as solvent in large quantities, the reuse of the recovered phenol leads to a considerable cost reduction.

While the invention has been described in detail and with reference to specific embodiments thereof, it will be apparent to one skilled in the art that various changes and modifications can be made therein without departing from the spirit and scope thereof.

What is claimed is:

1. A process for producing a mixture of bright color and high acid-neutralizing ability of sulfurized alkaline earth metal salts of a salicylic acid compound and a phenol which comprises reacting a mixture of reactants comprising a phenol, a dihydric alcohol, and an alkaline earth metal reagent in an amount of from 0.01 to 0.98 gram equivalent per equivalent of the phenol or a mixture of reactants comprising a phenol, a dihydric alcohol, an alkaline earth metal reagent in an amount of from 0.01 to 0.98 gram equivalent per equivalent of the phenol and water in an amount of 0.01 to 10 mol per mol of the alkaline earth metal reagent to thereby perform a metal addition reaction, said metal addition reaction being conducted at a temperature of from 60° to 200° C. and at a pressure of from 0.01 to 11 atm.A, wherein when water is present the amount of the dihydric alcohol is from 0.15 to 3.0 mol per mol of the alkaline earth metal reagent, and when water is not present the amount of the dihydric alcohol is from 0.1 to 3.0 mol per mol of the alkaline earth metal reagent, subsequently distilling off water and the dihydric alcohol, reacting the resulting bottom with carbon dioxide at a temperature of from about 150° to 240° C., a pressure of from about 0.05 to 100 atm and for a period of time of from about 1 to 10 hours, and then adding a dihydric alcohol in an amount of 0.01 to 10 mol per mol of the alkaline earth metal reagent and elemental sulfur in an amount of 0.1 to 4.0 mol per mol of the alkaline earth metal reagent to the resulting reaction product to conduct sulfurization reaction at a temperature of from about 60° to 200° C., at a pressure of from about 0.01 to 11 atm and for a period of time of from about 1 to 20 hours, wherein said alkaline earth metal reagent is an alkaline earth metal oxide, an alkaline earth metal hydroxide or a mixture of an alkaline earth metal oxide and an alkaline earth metal hydroxide.

2. The process of claim 1, wherein said phenol is recovered after said process and reused in said process.

3. A process for producing a mixture of bright color and high acid-neutralizing ability of sulfurized alkaline earth metal salts of a salicylic acid compound and a phenol which comprises reacting a mixture of reactants comprising a phenol, a dihydric alcohol, and an alkaline earth metal reagent in an amount of from 0.01 to 0.98 gram equivalent per equivalent of the phenol or a mixture of reactants comprising a phenol, a dihydric alcohol, an alkaline earth metal reagent in an amount of from 0.01 to 0.98 gram equivalent per equivalent of the phenol and water in an amount of 0.01 to 10 mol per mol of the alkaline earth metal reagent to thereby perform a metal addition reaction, said metal addition reaction being conducted at a temperature of from 60° to 200° C. and at a pressure of from 0.01 to 11 atm.A, wherein when water is present the amount of the dihydric alcohol is from 0.15 to 3.0 mol per mol of the alkaline earth metal reagent, and when water is not present the amount of the dihydric alcohol is from 0.1 to 3.0 mol per mol of the alkaline earth metal reagent, subsequently distilling off water and the dihydric alcohol, reacting the resulting bottom with carbon dioxide at a temperature of from about 150° to 240° C., a pressure of from about 0.05 to 100 atm and for a period of time of from about 1 to 10 hours, adding to the resulting reaction product an alkaline earth metal reagent in an amount of from 0.01 to 0.98 gram equivalent to the unreacted phenol present in the reaction product, reacting the resulting mixture in the presence of from 0.15 to 10 mol of a dihydric alcohol per mol of the alkaline earth metal reagent replenished to thereby perform a second metal addition reaction, subsequently distilling off water and part of the dihydric alcohol, and then reacting the resulting bottom with carbon dioxide at a temperature of from about 150° to 240° C., a pressure of from about 0.05 to 100 atm and for a period of time of from about 1 to 10 hours, said second metal addition reaction being followed by a step in which elemental sulfur in an amount of 0.1 to 4.0 mol per mol of the alkaline earth metal reagent is added to and reacted with the reaction product to conduct a sulfurization reaction at a temperature of from about 60° to 200° C., at a pressure of from about 0.01 to 11 atm and for a period of time of from about 1 to 20 hours, wherein said alkaline earth metal reagent is an alkaline earth metal oxide, an alkaline earth metal hydroxide or a mixture of an alkaline earth metal oxide and an alkaline earth metal hydroxide.

4. The process of claim 3, wherein said phenol is recovered after said process and reused in said process.

5. A process for producing a mixture of bright color and high acid-neutralizing ability of sulfurized alkaline earth metal salts of a salicylic acid compound and a phenol which comprises reacting a mixture of reactants comprising a phenol, a dihydric alcohol, and an alkaline earth metal reagent in an amount of from 0.01 to 0.98 gram equivalent per equivalent of the phenol or a mixture of reactants comprising a phenol, a dihydric alcohol, an alkaline earth metal reagent in an amount of from 0.01 to 0.98 gram equivalent per equivalent of the phenol and water in an amount of 0.01 to 10 mol per mol of the alkaline earth metal reagent to thereby perform a metal addition reaction, said metal addition reaction being conducted at a temperature of from 60° to 200° C. and at a pressure of from 0.01 to 11 atm.A, wherein when water is present the amount of the dihydric alcohol is from 0.15 to 3.0 mol per mol of the alkaline earth metal reagent, and when water is not present the amount of the dihydric alcohol is from 0.1 to 3.0 mol per mol of the alkaline earth metal reagent, subsequently distilling off water and the dihydric alcohol, reacting the resulting bottom with carbon dioxide at a temperature of from about 150° to 240° C., a pressure of from about 0.05 to 100 atm and for a period of time of from about 1 to 10 hours, to thereby form a resulting reaction product, and then adding a dihydric alcohol and elemental sulfur in an amount of 0.1 to 4.0 mol per mol of the alkaline earth metal reagent to the resulting reaction product to conduct sulfurization reaction at a temperature of from about 60° to 200° C., at a pressure of from about 0.01 to 11 atm and for a period of time of from about 1 to 20 hours, said sulfurization reaction being conducted at a temperature of 160° C. or higher in a pressurized open system with the amount of the dihydric alcohol added for the sulfurization reaction being 1.8 mol to 10 mol per mol of the alkaline earth metal reagent, wherein said alkaline earth metal reagent is an alkaline earth metal oxide, an alkaline earth metal hydroxide or a mixture of an alkaline earth metal oxide and an alkaline earth metal hydroxide, whereby due to the use of said dihydric alcohol in an amount of 1.8 mol to 10 mol per mol of the alkaline earth metal reagent and the conducting of the sulfurization at a temperature of 160° C. or higher, said recovered phenol does not become milky and is suitable for reuse in said process.

6. The process of claim 5, wherein said phenol is recovered after said process and reused in said process.

7. A process for producing a mixture of bright color and high acid-neutralizing ability of sulfurized alkaline earth metal salts of a salicylic acid compound and a phenol which comprises reacting a mixture of reactants comprising a phenol, a dihydric alcohol, and an alkaline earth metal reagent in an amount of from 0.01 to 0.98 gram equivalent per equivalent of the phenol or a mixture of reactants comprising a phenol, a dihydric alcohol, an alkaline earth metal reagent in an amount of from 0.01 to 0.98 gram equivalent per equivalent of the phenol and water in an amount of 0.01 to 10 mol per mol of the alkaline earth metal reagent to thereby perform a metal addition reaction, said metal addition reaction being conducted at a temperature of from 60° to 200° C. and at a pressure of from 0.01 to 11 atm.A, wherein when water is present the amount of the dihydric alcohol is from 0.15 to 3.0 mol per mol of the alkaline earth metal reagent, and when water is not present the amount of the dihydric alcohol is from 0.1 to 3.0 mol per mol of the alkaline earth metal reagent, subsequently distilling off water and the dihydric alcohol, reacting the resulting bottom with carbon dioxide at a temperature of from about 150° to 240° C., a pressure of from about 0.05 to 100 atm and for a period of time of from about 1 to 10 hours, to thereby form a resulting reaction product, and then adding a dihydric alcohol and elemental sulfur in an amount of 0.1 to 4.0 mol per mol of the alkaline earth metal reagent to the resulting reaction product to conduct sulfurization reaction at a temperature of from about 60° to 200° C., at a pressure of from about 0.01 to 11 atm and for a period of time of from about 1 to 20 hours, said sulfurization reaction being conducted at a temperature of 160° C. or higher in an atmospheric pressure open system with the amount of the dihydric alcohol added for the sulfurization reaction being 0.3 mol to 10 mol per mol of the alkaline earth metal reagent, wherein said alkaline earth metal reagent is an alkaline earth metal oxide, an alkaline earth metal hydroxide or a mixture of an alkaline earth metal oxide and an alkaline earth metal hydroxide, whereby due to the use of said dihydric alcohol in an amount of 0.3 to 10 mol per mol of the alkaline earth metal reagent and the conducting of the sulfurization at a temperature of 160° C. or higher, said recovered phenol does not become milky and is suitable for reuse in said process.

8. The process of claim 7, wherein said phenol is recovered after said process and reused in said process.

* * * * *